US006425796B1

(12) United States Patent
Gaynor et al.

(10) Patent No.: US 6,425,796 B1
(45) Date of Patent: Jul. 30, 2002

(54) FASHION DOLL TRANSFORMING FROM PRINCESS TO BRIDE

(75) Inventors: Joan Gaynor, Torrance; Tina Ying Yang, Placentia; Ivy Ross, Manhattan Beach, all of CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 09/779,167

(22) Filed: Feb. 8, 2001

(51) Int. Cl.[7] ..... A63H 3/28

(52) U.S. Cl. ..... 446/298; 446/330; 446/376; 446/390; 434/393; 40/419

(58) Field of Search ..... 446/268, 296, 446/297, 298, 321, 330, 337, 376, 390, 474; 434/365, 393, 396; 40/411, 419, 421, 436, 427

(56) References Cited

U.S. PATENT DOCUMENTS

| | | | | | |
|---|---|---|---|---|---|
| 1,680,016 | A | | 7/1928 | Dawley | |
| 1,966,986 | A | | 7/1934 | Martin | |
| 2,469,589 | A | | 5/1949 | Barricini | |
| 2,628,722 | A | * | 2/1953 | Walsh | |
| 2,639,547 | A | * | 5/1953 | Adler | 446/354 |
| D190,789 | S | | 6/1961 | Levis | |
| 3,731,427 | A | * | 5/1973 | Lewis et al. | 446/390 |
| 4,072,314 | A | | 2/1978 | Rosen et al. | |
| 4,157,633 | A | * | 6/1979 | Reiner et al. | 446/219 |
| 4,414,774 | A | | 11/1983 | Fogarty et al. | |
| 4,541,727 | A | * | 9/1985 | Rosenthal | 40/454 |
| 4,921,459 | A | | 5/1990 | Cook et al. | |
| 5,149,289 | A | | 9/1992 | Edwards et al. | |
| 5,228,879 | A | | 7/1993 | Fromm | |
| D347,038 | S | | 5/1994 | Sachetti | |
| 5,403,223 | A | * | 4/1995 | Gaulkin et al. | 446/219 |
| D364,661 | S | | 11/1995 | Azocar | |
| D370,240 | S | | 5/1996 | Spangenberg | |
| 5,676,584 | A | | 10/1997 | Perryman | |
| 5,868,598 | A | | 2/1999 | Dinovo | |
| 5,999,317 | A | | 12/1999 | Whitney | |

* cited by examiner

*Primary Examiner*—Jacob K. Ackun
*Assistant Examiner*—Bena B. Miller
(74) *Attorney, Agent, or Firm*—Roy A. Ekstrand

(57) ABSTRACT

A fashion doll includes a doll body wearing a wedding gown together with an overlying removable princess bodice. The doll further includes a pivotable arm which in turn supports a hand mirror. The outer face of the hand mirror supports a dual image lenticular lens display which transforms the presented image in response to pivotal movement of the doll's arm. The doll further supports a tiara worn upon the doll's head together with a wedding veil which is alternately attachable to the doll's waist and to the tiara. A sound circuit within the doll's body responds to the pivotal movement of the doll's arm to produce a musical tone.

6 Claims, 3 Drawing Sheets

FASHION DOLL TRANSFORMING FROM PRINCESS TO BRIDE

FIELD OF THE INVENTION

This invention relates generally to fashion dolls and particularly to accessories and play patterns utilized in conjunction therewith.

BACKGROUND OF THE INVENTION

Fashion dolls have proven to be an extremely popular and long-lasting type of toy products. As initially introduced, fashion dolls were relatively simple plastic dolls having colorful and entertaining removable and interchangeable clothing articles. As the popularity of fashion dolls continued to increase, a virtually endless number of accessories and such were provided by practitioners in the art to further enhance the play value of fashion dolls. Concurrently, fashion dolls themselves became more complex with increased functionality and variety. The advent of relatively inexpensive mass-produceable integrated circuit sound units in turn led to the addition of various sound features to fashion dolls.

As a result of this extended and continuous product development, a substantial variety of fashion dolls and accessories therefor have continued to be provided by practitioners in the art. For example, U.S. Pat. No. 4,414,774 issued to Fogarty, et al. sets forth a FASHION AND HAIRSTYLE DOLL PLAY SET having a self-standing three-dimensional doll and various removably attachable articles which simulate clothing, head gear and natural hair. The doll itself comprise a rigid or semi-rigid body with integrally formed limbs and a semi-rigid or flexible head with an integrally formed sculptured hair design. The waist of the doll body is configured as a circular cylinder and the head has an essentially horizontal encircling recess above the lower periphery of its sculpted hair design.

U.S. Pat. No. Des. 364,661 issued to Azocar sets forth an ILLUMINATED DOLL showing an aesthetic design for a free-standing doll and clothing articles to be worn thereby.

U.S. Pat. No. Des. 370,240 issued to Spangenberg sets forth a DOLL having a princess or queen-like appearance and supporting a crown. The doll is configured in a seated posture.

U.S. Pat. No. Des. 347,038 issued to Sachetti sets forth a TOY FIGURE having a free-standing fashion type doll formed as a substantially planar two-dimensional "cutout" type object.

U.S. Pat. No. 5,868,598 issued to Dinovo sets forth a BOW DISPLAY, STORAGE AND HOOP SUBSTITUTE DEVICE FOR A DOLL'S SKIRT having a free-standing doll supporting an inner skirt and an outer covering skirt overlying a portion of the inner skirt. The inner skirt is fabricated to form an internal enclosure and is formed of a mesh-like material. A plurality of decorative objects such as bows or the like are captivated within the mesh-like underskirt and provide aesthetic enhancement of the skirt.

U.S. Pat. No. 5,149,289 issued to Edwards, et al. sets forth a TRANSFORMABLE DOLL having a pair of oppositely oriented upper torso head and arm combinations for two differently appearing dolls joined at their respective common waists. A skirt encircles the common waist and is movable to cover either of the upper torso portions of the opposed dolls to render one doll portion visible and hide or obscure the other.

U.S. Pat. No. 4,921,459 issued to Cook, et al. sets forth a MULTICHARACTER DOLL having a plurality of doll upper torsos joined in a cruciform arrangement. Each doll upper torso supports a head and extending arms and defines a different appearance. A covering skirt is secured about the waist of one doll upper torso and positioned to cover the remaining doll upper torsos.

U.S. Pat. No. 5,676,584 issued to Perryman sets forth a DOLL WITH INTERCHANGEABLE FACES having a plain and nondescript head portion extending from the main body of the doll. A series of headslip covers each having a distinct facial expression thereon may be placed upon the doll's head to provide the doll with a facial expression.

U.S. Pat. No. 1,966,986 issued to Martin sets forth a DOLL having a pair of opposed upper torso body portions each supporting a head and arm pair and each commonly joined at a common waist is provided with a covering skirt also secured to the doll waist allowing the skirt to Cover one doll torso and expose the other.

In a different art generally related to the present invention, U.S. Pat. No. Des. 190,789 issued to Levis sets forth a design for a HAND MIRROR having a handle, a generally disk-shaped mirror supported thereby and a doll face formed on the non-mirrored side thereof.

U.S. Pat. No. 5,228,879 issued to Fromm sets forth a TOY MIRROR ASSEMBLY having a handheld two-way mirror assembly having one or more hidden images mounted behind the back surface of a two-way mirror. Each of the images may be independently seen when a correspondingly light behind the image is activated.

U.S. Pat. No. 4,072,314 issued to Rosen, et al. sets forth a SOUND-PRODUCING MIRROR TOY having a base supporting an oval-shaped mirror housing in a pivotal attachment. The mirrored housing further supports a two-way mirror and a light source therein. An image such as a face is produced within the oval-shaped housing when the light is activated. The image is visible through the mirror face.

U.S. Pat. No. 5,999,317 issued to Whitney sets forth a TOY MIRROR WITH TRANSMISSIVE IMAGE MODE having a first polarizer and a second polarizer movable relatively to the first. In a first mode, the first and second polarizers interact to provide a reflective quality while in a second mode the first and second polarizers are transmissive. The toy may further include an object or image located adjacent the second polarizer.

U.S. Pat. No. 2,469,589 issued to Barricini sets forth a CONFECTION WITH SUPPORT THEREFOR generally resembling a handheld mirror and supporting an object within the confection portion which is viewable through the confection material.

U.S. Pat. No. 4,157,633 issued to Reiner, et al. sets forth a DOLL AND DEVICE apparently superposing an object on a doll's reflected image while U.S. Pat. No. 1,680,016 issued to Dawley sets forth a DISPLAY DEVICE both of which utilize a mirror as part of the display.

While the foregoing described prior art devices have to some extent improved the art and have in some instances enjoyed commercial success, there remains nonetheless a continuing need in the art for evermore improved interesting and amusing fashion dolls and play patterns therefor.

SUMMARY OF THE INVENTION

Accordingly, it is a general object of the present invention to provide an improved and more amusing fashion doll. It is a more particular object of the present invention to provide an improved and more amusing fashion doll which includes a fanciful play pattern having a fairy tale like theme or quality.

In accordance with the present invention, there is provided a fashion doll comprising: a doll body having a head, a quantity of simulated hair, a torso and an arm pivotable between a raised and a lowered position, the arm including a hand; a hand mirror attachable to the hand and having a dual-image lenticular display for presenting a first image when the arm is in the lowered position and a second image when the arm is in the raised position; and a sound unit supported by the doll body responsive to pivotal movement of the arm to produce an audible sound.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
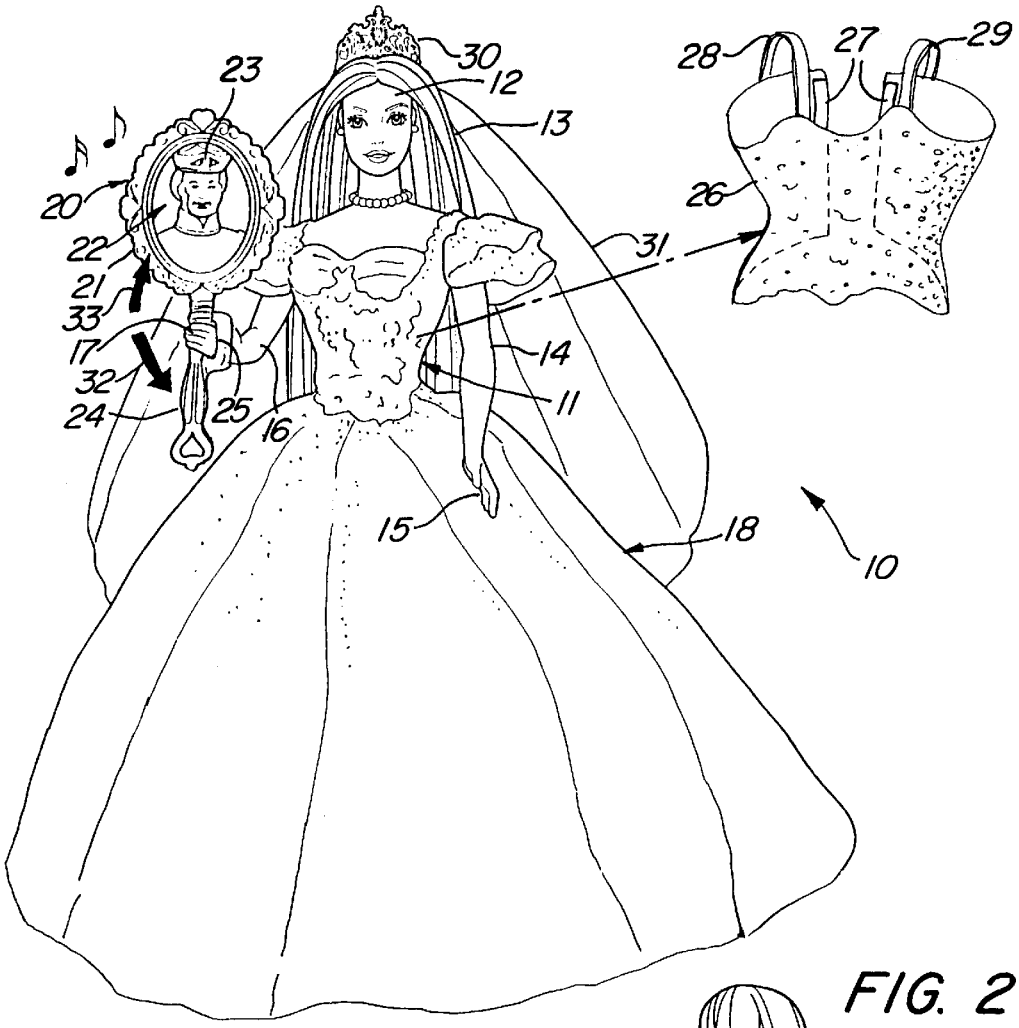
FIG. 1 sets forth a perspective view of a fashion doll constructed in accordance with the invention.

FIG. 1 sets forth a perspective view of a fashion doll constructed in accordance with the present invention and generally referenced by numeral 10. Doll 10 includes a doll body 11 having a pairs of arms 14 and 16 together with a head 12. Head 12 supports a quantity of simulated hair 13. While not seen in FIG. 1, it will be understood that doll body 11 further includes a pair of supporting legs. Doll body 11 is preferably fabricated of a molded plastic material or the like. Doll 10 further includes a wedding gown 18 supported upon doll body 11. A tiara 30 is shown in FIG. 1 supported upon hair 13 and head 12. In further accordance with the present invention, a wedding veil 31 is secured to tiara 30 in the manner shown in FIG. 3.

FIG. 1 also shows a princess bodice 26 removed from doll body 11. Bodice 26 is fabricated to fit upon the upper torso of doll body 11 overlying wedding gown 18. Bodice 26 includes a pair of shoulder straps 28 and 29 and a split back opening which may be closed using a pair of attachment pads 27. In accordance with the princess-to-bride play pattern of the present invention, bodice 26 is preferably fabricated of a non-white or contrasting color such that the wearing of bodice 26 overlying wedding gown 18 upon doll body 11 creates a different apparel from that which is provided by wedding gown 18.

Arms 14 and 16 supports hands 15 and 17 also formed of molded plastic material or the like.

In accordance with the present invention, a hand mirror 20 includes a handle 24, a grip 25 and an image display 22. Image display 22 operates in the manner set forth below in greater detail to present either of two alternative images depending upon the angular positioning of mirror 20. Suffice it to note here that display 22 comprises a conventional lenticular lens image combination which provides this capability of alternate image display. In the position shown in FIG. 1, hand mirror 20 is secured to hand 17 of doll body 11 and is positioned by rotation of arm 16 to expose image 23 to the viewer. As is described below, the downward rotation of arm 16 in the direction indicated by arrow 32 changes the image presented within display 22. Conversely, the upward pivotal movement of arm 16 in the direction indicated by arrow 33 raises hand mirror 20 and causes display 22 to present image 23.

In the anticipated play pattern of the present invention, doll 10 is initially configured having wedding gown 18 and princess bodice 26 supported upon doll body 11. Additionally, tiara 30 is attached to hair 13 and head 12 while veil 31 is supported at the waist portion of wedding gown 18 in the manner set forth below in FIG. 2. In further accordance with the anticipated play pattern of the present invention, doll 10 having been thus configured in the "princess" appearance, hand mirror 20 is positioned upon hand 17 and arm 16 is pivoted downwardly to its lowered position (seen in FIG. 5) in the direction indicated by arrow 32. This downward pivoting movement of arm 16 and hand mirror 20 causes display 22 of hand mirror 20 to present the image condition shown in FIG. 6. Thus, in this manner, the present invention doll appears to be seeing its own image in the hand mirror. In accordance with the use of doll 10 to provide a play pattern for the child user, it will be noted that display 22 is actually positioned on the outwardly facing portion of hand mirror 20 and is thus visible to the child user playing with the doll.

In further accordance with the anticipated play pattern of the present invention doll, the child user then pivots arm 16 upwardly in the direction indicated by arrow 33. This upward movement of arm 16 operates a sound circuit (set forth in FIGS. 4 and 5) which then produces an audible musical tone. Simultaneously, the upward movement of hand mirror 20 as the child user pivots arm 16 causes a reorientation of hand mirror 20 such that display 22 now presents alternate image 23 which again is visible to the child user. In further accordance with the fanciful play pattern of the present invention doll, alternate image 23 depicts a "handsome prince" which is once again seen by the child user as part of the fanciful play.

The transformation of the present invention doll following the visualization of the handsome prince image is enhanced by the child's activity of removing princess bodice 26 and in the manner set forth below in FIGS. 2 and 3 removing veil 31 from the waist attachment shown in FIG. 2 to the tiara attachment shown in FIG. 3 to present the complete bride transformation of doll 10. In this manner utilizing relatively simple apparatus and accessory components, the present invention doll undergoes a very fanciful and pleasing transformation by the child user in manipulating the doll from a princess to a bride once the handsome prince image has been visualized.

Figure 2:
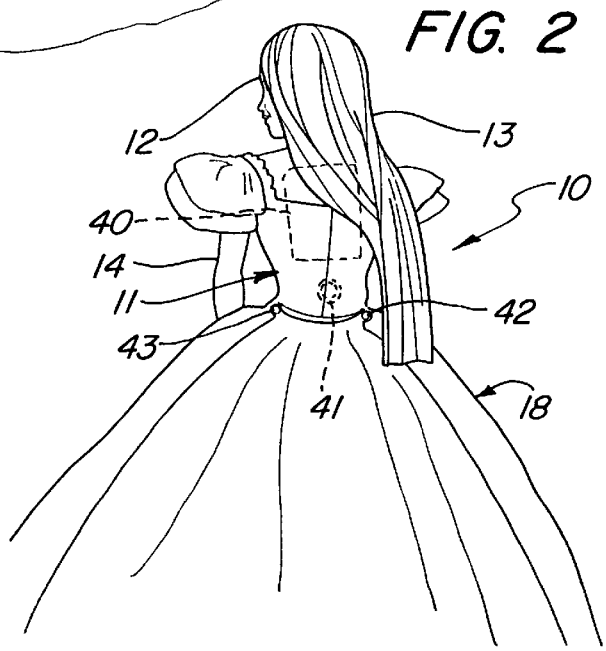
FIG. 2 sets forth a rear perspective view of the present invention doll.

FIG. 2 sets forth a rear perspective view of doll 10 showing doll body 11 supporting an arm 14, a head 12 and a quantity of simulated hair 13. Doll body 11 further supports a sound unit 40 and a button 41 shown in dashed-line representation. A gown 11 depicting a wedding gown in supported upon doll body 11. FIG. 2 also shows a pair of attachment buttons 42 and 43 supported upon the waist portion of gown 11. As is better seen in FIG. 3, veil 31 supports a pair of eyelets 34 and 35 which are used to removably secure veil 31 to buttons 42 and 43 of gown 18. In this manner, veil 31 (seen in FIG. 3) is initially secured to gown 18 in the "princess" configuration of doll 10.

Figure 3:
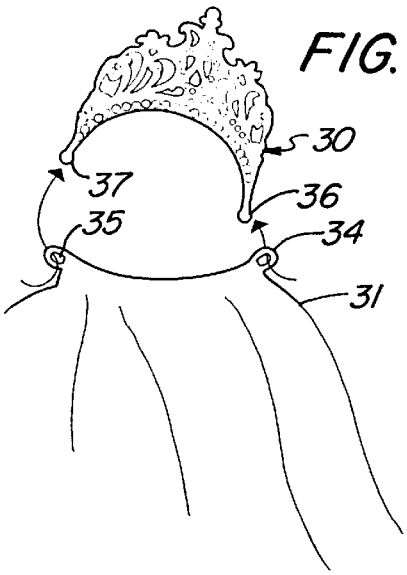
FIG. 3 sets forth a partial assembly view of the tiara and veil assembly of the present invention doll.

FIG. 3 sets forth a partial perspective assembly view showing tiara 30 in its attachment to veil 31 during the transformation of doll 10 to its bride configuration. Accordingly, tiara 30 includes a pair of posts 36 and 37. In cooperating features, veil 31 includes a pair of eyelets 34 and 35 which may be utilized to secure veil 31 to tiara 30 as post 36 and 37 respectively are forced through eyelets 34 and 35. In this manner, veil 31 may be secured to tiara 30 in the bride configuration shown in FIG. 1.

Figure 4:
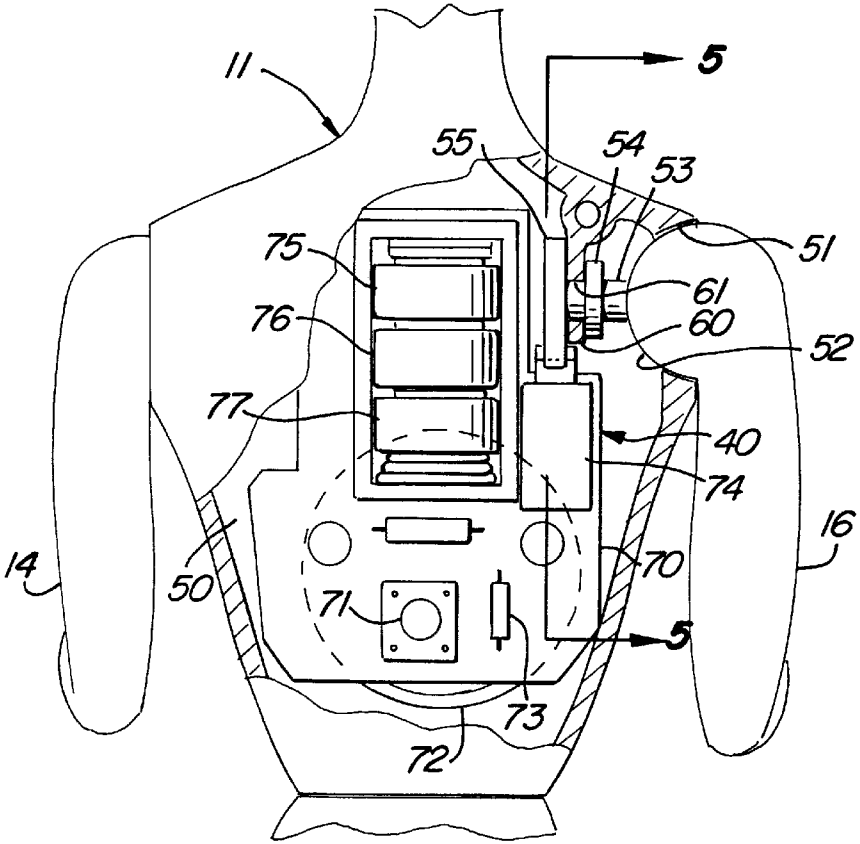
FIG. 4 sets forth a partial section rear view of the upper torso portion of the present invention fashion doll.

FIG. 4 sets forth a partial section rear view of the upper torso portion of doll body 11. Doll body 11 is hollow and defines an interior cavity 50 within which a sound unit 40 is supported. Sound unit 40 includes a switch 71 which is positioned in alignment with push button 41 (seen in FIG. 2). Sound unit 40 further includes a plurality of batteries 75, 76 and 77 together with a plurality of sound circuit components such as component 73. Switch 71, components 73, switch 74 and batteries 75 through 77 are supported upon a circuit board 70 in accordance with conventional fabrication techniques. Sound unit 40 further includes a sound transducer 72 also operatively supported upon circuit board 73.

Doll body 11 further defines a shoulder socket 51 and an interior wall 60 having an aperture 61 formed therein. Arm 16 defines a ball portion 52 received within socket 51 and having an inwardly extending arm shaft 53. Arm shaft 53 passes through aperture 61 of wall 60 and further supports a flange 54 and a cam 55. Cam 55 is better seen in FIG. 5. However, suffice it to note here that cam 55 is positioned in alignment with switch 74. Suffice it also to note here that pivotal movement of arm 16 provides corresponding pivotal movement of cam 55 which in the manner seen in FIG. 5 actuates switch 74 which in turn energizes sound circuit 40. Accordingly, as arm 16 is raised in the manner described above in FIG. 1, sound circuit 40 is activated causing transducer 72 to produce a musical sound which accompanies the apparent transformation of the images upon display 22 of hand mirror 20 (also seen in FIG. 1).

Figure 5:
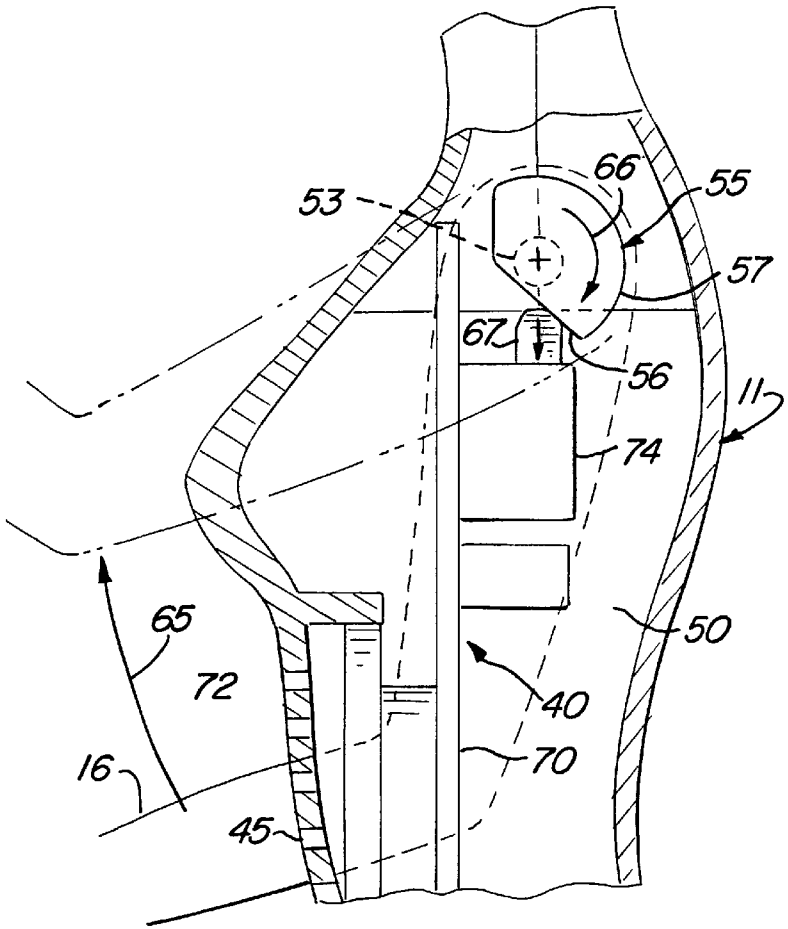
FIG. 5 sets forth a partial section side view of the present invention doll taken along section lines 5—5 in FIG. 4.

FIG. 5 sets forth a partial section view of the upper torso portion of doll body 11 taken along section lines 5—5 therein. As described above, doll body 11 defines an interior cavity 50 and supports a sound unit 40 and an arm 16. Sound unit 40 includes a circuit board 70 having a switch 74 and a transducer 72 supported thereon. As is also described above, arm 16 is supported upon doll body 11 by a shaft 53. Shaft 53 includes a cam 55 having an outer circular edge 57 and an angled cam face 56. A plurality of apertures are formed in doll body 11 to define a speaker grille 45 in the front portion of doll body 11.

In operation with arm 16 initially positioned in its lower position as shown in solid-line representation in FIG. 5, cam 55 is rotated away from actuation of switch 74. As the child user raises arm 16 in the direction indicated by arrow 65, cam 55 is pivoted about shaft 53 in the direction indicated by arrow 66. This pivotal movement of cam 55 brings cam face 56 against the actuating button of switch 74 depressing the actuating button of switch 74 in the direction of arrow 67. This in turn activates switch 74 which causes sound unit 40 to produce an audible sound via transducer 72. Thus, as the child user raises arm 16, sound unit 40 produces an accompanying sound.

Figure 6:
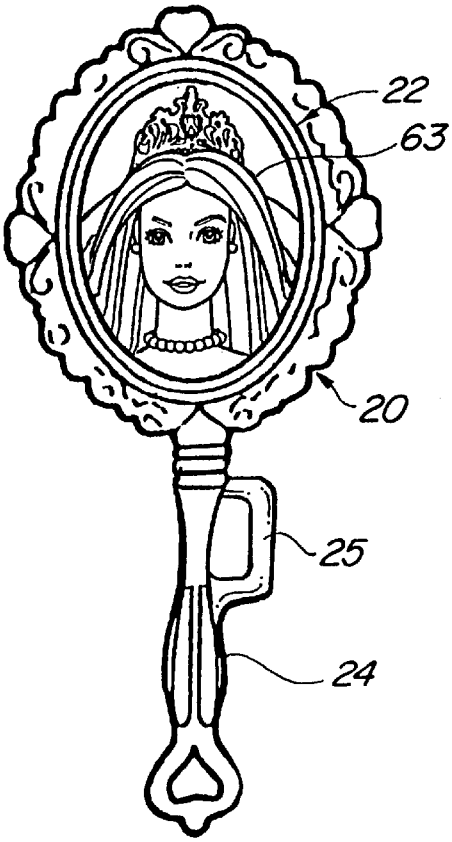
FIG. 6 sets forth a front view of the handheld mirror accessory of the present invention doll showing one image viewable therein.
Figure 7:
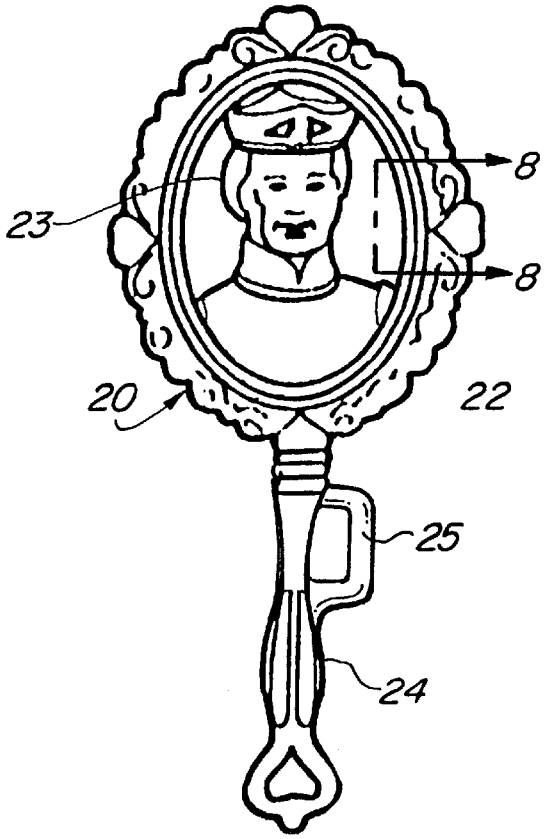
FIG. 7 sets forth a front view of the handheld mirror accessory of FIG. 6 showing the alternate image viewable therein.

FIGS. 6 and 7 set forth substantially identical views of hand mirror 20. FIG. 6 and 7 differ solely in the image viewable upon display 22 therein. Accordingly, hand mirror 20 includes a handle 24 supporting a display portion 22 and a grip 25. In FIG. 6, the angular position of mirror 20 causes image 63 (the princess image) to be seen in display 22. Conversely, in FIG. 7, the angular position of hand mirror 20 is offset slightly causing display 22 to present alternate image 23 (the handsome prince image). This capability of producing alternate images based upon small angular movement of the hand mirror is provided by the well known apparatus known as a lenticular display.

Figure 8:
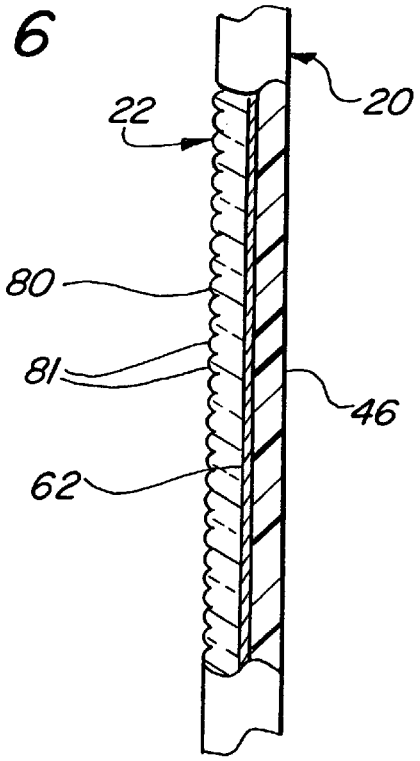
FIG. 8 sets forth a partial section view of the handheld mirror accessory shown in FIG. 7 taken along section lines 8—8 therein.

FIG. 8 sets forth a partial section view of hand mirror 20 taken along section lines 8—8 in FIG. 7. The importance of FIG. 8 is to show the use of a well known structure known as a lenticular display for providing the desired image transformation with hand mirror 20. Thus, hand mirror 20 includes a backing portion 46 supporting an image substrate 62 and a lenticular lens 80. Lenticular lens 80 is formed of a plurality of horizontally disposed substantially parallel cylindrical lens elements 81. In further accordance with the conventional fabrication of display 22, image substrate 62 supports images 23 and 63 (seen in FIGS. 6 and 7) in the form of a plurality of interleaved image stripes. The cooperation of the image stripes upon substrate 62 and cylindrical lens elements 81 provides the image change function of display 22.

What has been shown is a simple but novel fashion doll which performs a princess-to-bride transformation while using a variety of amusing accessories. The accessories include a lenticular lens display hand mirror together with a transformable garment apparel.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A fashion doll comprising:

a doll body having a head, a quantity of simulated hair, a torso and an arm pivotable between a raised and a lowered position, said arm including a hand;

a hand mirror attachable to said hand and having a dual-image lenticular display for presenting a first image when said arm is in said lowered position and a second image when said arm is in said raised position; and a sound unit supported by said doll body responsive to pivotal movement of said arm to produce an audible sound.

2. The fashion doll set forth in claim 1 wherein said sound unit includes an activation switch and wherein said arm includes a cam pivotal therewith, said cam activating said switch when said arm pivots.

3. The fashion doll set forth in claim 2 further including a tiara upon said head and a veil.

4. The fashion doll set forth in claim 3 wherein said veil includes a pair of eyelets and wherein said tiara includes a pair of posts and wherein said gown includes a pair of attachment buttons, said veil being alternatively attached by said eyelets to said tiara at said posts or to said gown at said attachment buttons.

5. The fashion doll set forth in claim 4 wherein said gown is a wedding gown and wherein said fashion doll further includes a bodice removably securable to said doll body overlying a portion of said gown.

6. A fashion doll transformable between a princess and a bride, said fashion doll comprising:

a doll body having a head, a quantity of simulated hair, an arm having a hand, means for pivotably supporting said arm;

a tiara having first veil attachment means receivable upon said head;

a wedding gown upon said doll body having second veil attachment means;

a wedding veil having third veil attachment means, said third veil attachment means cooperating with said first veil attachment means to secure said wedding veil to said tiara or cooperating with said second veil attachment means to secure said wedding veil to said gown;

a hand mirror, attachable to said hand, having a dual-image lenticular display for producing a princess image when said arm is lowered and a prince image when said arm is raised; and a sound unit within said doll body having means responsive to movement of said arm for producing audible sound.

* * * * *